US011154123B1

(12) United States Patent
Smullen et al.

(10) Patent No.: US 11,154,123 B1
(45) Date of Patent: Oct. 26, 2021

(54) PORTABLE OFFICE-IN-A-BOX

(71) Applicant: South Winston LLC, Delray Beach, FL (US)

(72) Inventors: Richard Adam Smullen, Delray Beach, FL (US); Jose Margulis, Miami, FL (US); Iima Zubakhina, Miami, FL (US)

(73) Assignee: WORKY LIFE LLC, Miami, FL (US)

( * ) Notice: Subject to any disclaimer, the term of this patent is extended or adjusted under 35 U.S.C. 154(b) by 0 days.

(21) Appl. No.: 17/000,361

(22) Filed: Aug. 23, 2020

Related U.S. Application Data

(60) Provisional application No. 63/039,451, filed on Jun. 15, 2020.

(51) Int. Cl.

| | |
|---|---|
| ***A45C 9/00*** | (2006.01) |
| ***A45C 3/02*** | (2006.01) |
| ***A45C 13/02*** | (2006.01) |
| ***A45C 15/06*** | (2006.01) |
| *E05B 65/52* | (2006.01) |

(52) U.S. Cl.
CPC ..... *A45C 9/00* (2013.01); *A45C 3/02* (2013.01); *A45C 13/02* (2013.01); *A45C 15/06* (2013.01); *A45C 2013/025* (2013.01); *A45C 2200/20* (2013.01); *E05B 65/52* (2013.01)

(58) Field of Classification Search
CPC ..... A45C 3/02; A45C 9/00; A45C 13/005; A45C 15/06; A45C 2011/003; A45C 2013/025; A45C 2200/20; A45C 13/02; E05B 65/52
USPC ..... 190/11, 108, 109; 206/320
See application file for complete search history.

(56) References Cited

U.S. PATENT DOCUMENTS

| | | | | |
|---|---|---|---|---|
| 4,837,590 | A * | 6/1989 | Sprague | B41J 3/36 190/1 |
| 6,362,954 | B1 * | 3/2002 | LeVander | G06F 1/1628 190/100 |
| 6,454,064 | B1 * | 9/2002 | Cheng | A45C 9/00 190/11 |
| 6,499,857 | B1 * | 12/2002 | Lumley | A43B 1/0036 362/103 |
| 9,380,847 | B1 * | 7/2016 | Killebrew | A45C 9/00 |
| 9,492,904 | B1 * | 11/2016 | Dunn | A45C 5/06 |

(Continued)

FOREIGN PATENT DOCUMENTS

EP 1072441 A2 * 1/2001 ..... A47B 97/001

*Primary Examiner* — Sue A Weaver
(74) *Attorney, Agent, or Firm* — Ashok Tankha

(57) ABSTRACT

The portable office-in-a-box allows a user to readily transport and set up an office and workstation at any location. The portable office-in-a-box comprises a substantially rectangular shaped box comprising a base, a lid configured to engage with the base to define the rectangular shaped box, multiple panels, one or more enclosures, multiple mounting fixtures, office equipment and office supplies. The multiple panels are disposed on an inner surface of the base, and inner surface of the lid. A first set of the panels secure one or more office items, and a second set of the panels define one or more enclosures to secure other office items. Multiple drawers slidably engage with the base for providing storage of office equipment and office supplies. Multiple mounting accessories are disposed on the inner surface of the lid for securing office equipment and accessories.

8 Claims, 17 Drawing Sheets

(56) References Cited

U.S. PATENT DOCUMENTS

| | | | | |
|---|---|---|---|---|
| 2007/0177344 | A1* | 8/2007 | Hsia | A45C 13/02<br>361/679.28 |
| 2007/0215011 | A1* | 9/2007 | Khan | A47B 3/10<br>108/11 |
| 2011/0011760 | A1* | 1/2011 | Habersetzer | G06F 1/1628<br>206/320 |
| 2011/0020783 | A1* | 1/2011 | Davidov | B43M 99/009<br>434/430 |
| 2014/0216873 | A1* | 8/2014 | Torres Montes | A45C 9/00<br>190/11 |
| 2014/0346764 | A1* | 11/2014 | Lee | B43L 1/00<br>281/45 |
| 2016/0087469 | A1* | 3/2016 | Armstrong | H02J 7/0003<br>320/107 |
| 2016/0355299 | A1* | 12/2016 | Lapoint | B65D 25/04 |
| 2016/0360351 | A1* | 12/2016 | Cabouli | G08B 13/06 |

* cited by examiner

PORTABLE OFFICE-IN-A-BOX

CROSS-REFERENCE TO RELATED APPLICATIONS

This application claims priority to and the benefit of the provisional patent application titled "Portable Office-In-A-Box", application No. 63/039,451, filed in the United States Patent and Trademark Office on Jun. 15, 2020. The specification of the above referenced patent application is incorporated herein by reference in its entirety

FIELD OF THE INVENTION

The apparatus disclosed herein relates to a portable office apparatus, hereafter an office-in-a-box. The portable office-in-a-box allows a user to readily transport and set up an office and workstation at any location, for example, at a location remote from the user's brick and mortar office or residence, and to allow the user to work in an office setting at the transported location.

In an embodiment, the office-in-a-box disclosed herein is a workstation that allows a user to conveniently and safely transports office equipment and work materials to any location, for example, at a location remote from the user's brick and mortar office, for example, to a conference, where the user can perform office functions and showcase presentation materials posted or displayed in the office-in-a-box to third parties at the conference.

BACKGROUND

Professional persons like managers, engineers, sales personnel, freelancers, etc. hereafter a user, who are on the move need an office-in-a-box that can be easily transported to a location, remote from the user's normal brick and mortar office, and thereafter allow the transported portable office-in-a box to be readily installed and set up at the remote location.

There is a long felt but unmet need for a portable office that a user can readily transport and set up an office and workstation at any location, for example, at a location remote from the user's brick and mortar office or residence, and to allow the user to work in an office setting at any location. There is also a long felt but unmet need for a portable office-in-a-box to accommodate and to make readily available to a user multiple office desk devices at the office-in-a-box's transported location. There is also a long felt but unmet need for a portable office-in-a-box that a user can use as a presentation office to showcase and display user material to a potential client, an audience, etc., at any location, for example, at a conference, at a client's or potential customer's office, etc. Furthermore, there is a long felt but unmet need for a portable office-in-a-box that is compact in design, easy to store, lightweight, durable, transportable and that allows a user to easily assemble and transport the portable office-in-a box to any location, and thereafter to readily assemble and set-up the portable office-in-a box at the transported location.

DETAILED DESCRIPTION OF THE INVENTION

Figure 1:
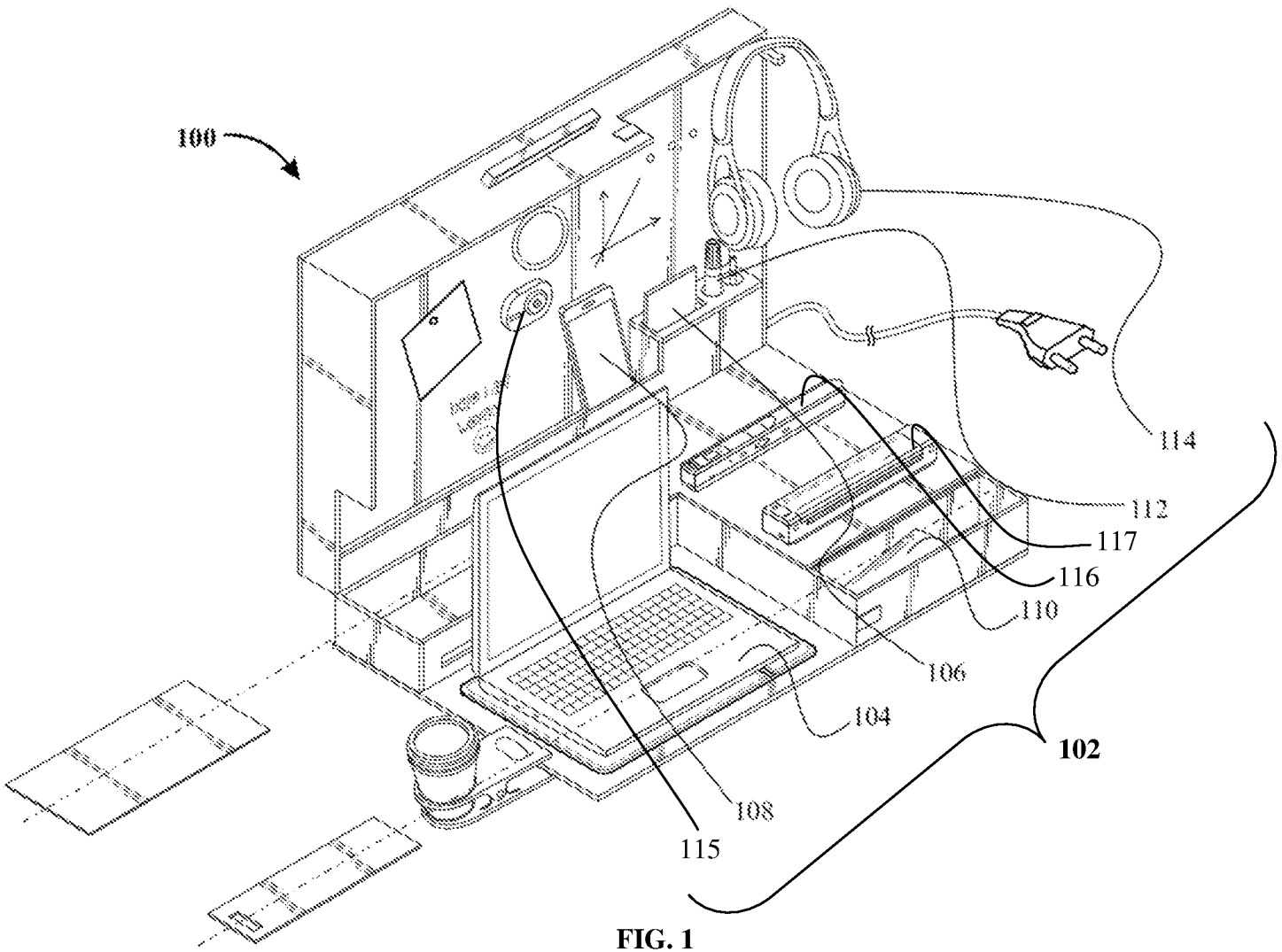
FIG. 1 exemplarily illustrates a front left-side perspective view of the portable office-in-a-box with one or more office items.
Figure 2:
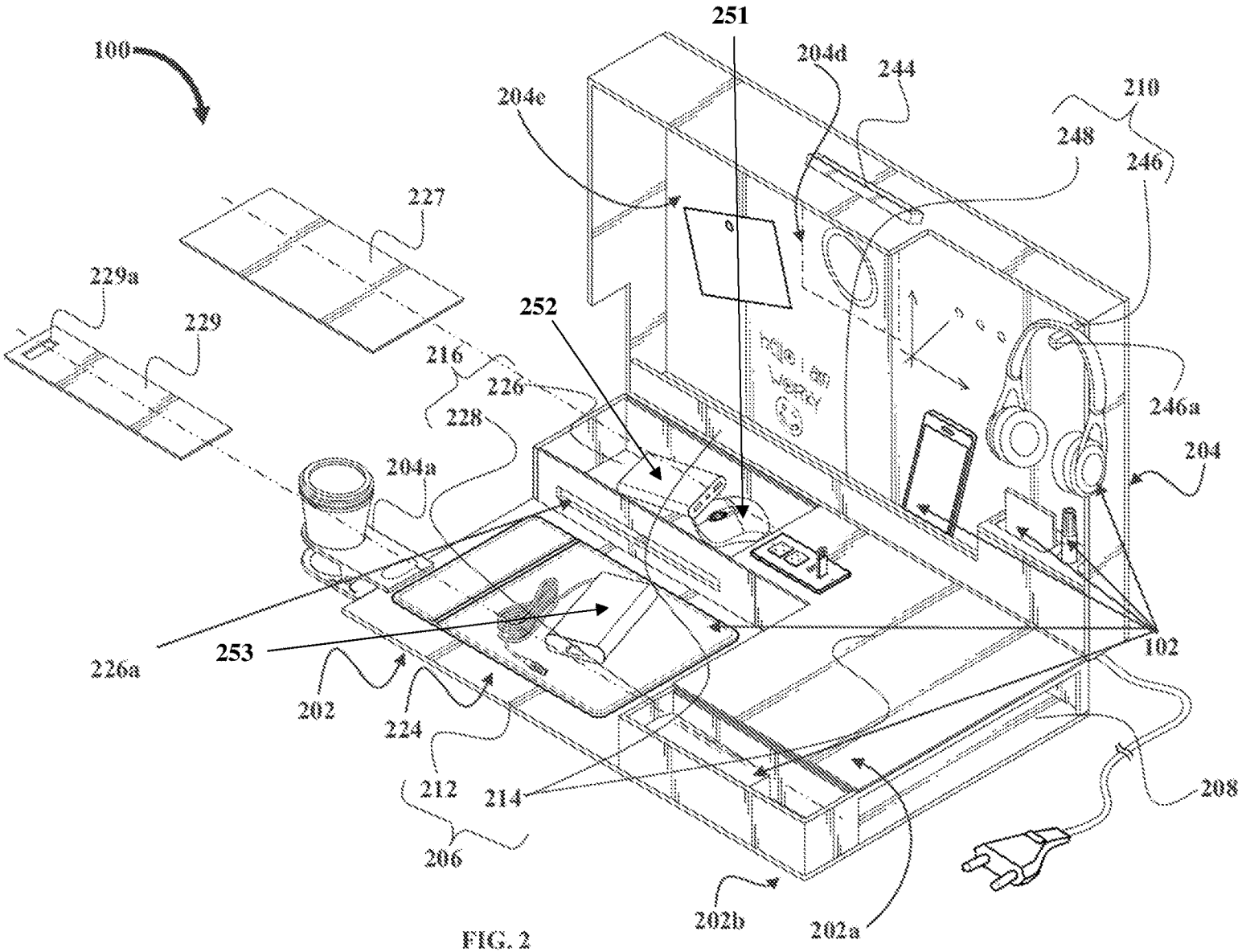
FIG. 2 exemplarily illustrates a front right-side perspective view of the portable office-in-a-box in an open configuration.

The apparatus disclosed herein relates to a portable office apparatus, hereafter an office-in-a-box. The portable office-in-a-box 100 comprises a substantially rectangular shaped box 400 comprising a base 202, a lid 204 configured to engage with the base 202 to define the rectangular shaped box 400, multiple panels 206, one or more enclosures 216, multiple mounting fixtures 210, and office equipment and office supplies. The portable office-in-a-box 100 allows a user to readily transport and set up an office and workstation at a transported location, for example, at a location remote from the user's brick and mortar office or residence, and to allow the user to work in an office setting at the transported location. FIG. 1 exemplarily illustrates a front left-side perspective view of the portable office-in-a-box 100 in an open configuration with one or more office items 102 disposed within the portable office-in-a-box 100. The portable office-in-a-box 100 addresses the need of a user for an office that is portable, transportable and ready to function as a workstation and office at any location, for example, at a location remote from the user's brick and mortar office or residence. The portable office-in-a-box 100 is configured to accommodate office equipment within the box 100. As shown in FIGS. 1 and 2, the portable office-in-a-box 100 is configured to hold office items 102 comprising a laptop 104, a 3 inches×3 inches standard post 106, a mobile phone 108, writing instruments 110, markers 112, one or more headphones 114, and miscellaneous office items 102 comprising a mouse 251, one or more chargers 252, a portable printer 117, a portable scanner 116, papers 239, a webcam 115, and power adaptors 253.

FIG. 2 exemplarily illustrates a front right-side perspective view of the portable office-in-a-box 100 in an open configuration. The portable office-in-a-box 100 is substantially rectangular in shape and comprises a base 202, a lid 204 configured to engage with the base 202, multiple panels 206, one or more storage compartments 208, 248, and 216 without a lid, and multiple mounting fixtures 210. In an embodiment, storage compartments 208, 248 and 216 are provided with a lid 227, 229 to enclose the contents within the storage compartments. The lid 204 of the portable office-in-a-box 100 when closed on the base 202 defines the substantially rectangular shaped portable office-in-a-box 100. The lid 204 when completely opened rests substantially perpendicular to the base 202. In an embodiment, the angle between the lid 204 and the base 202 can be varied to position the lid 204 at any angle between 60 degrees to 120 degrees. Multiple panels 206 are disposed within the inner surface 202*a* of the base 202 and the inner surface 204*b* of the lid 204. A first set 212 of the panels 206 is configured to secure one or more office items 102, and a second set 214 of the panels 206 defines one or more enclosures 216 in which office items 102 are positioned and secured. The storage compartments 208 are disposed on the base 202, and the mounting fixtures 210 are disposed on the inner surface 204*b* of the lid 204 for mounting office items 102. In an embodiment, the storage compartment 208 is a drawer 238, shown in FIG. 3, that slidably engages with the base 202 of the portable office-in-a-box 100. The portable office-in-a-box 100 is compact and has a desk surface dimension of, for example, about 26 inches in length, about 16 inches in width, and about 5 inches in height when closed. In an embodiment, the length, width and thickness of the portable office-in-a-box is about 15.7 inches, 25.8 inches, and about 4.4 inches, respectively. The portable office-in-a-box 100 is manufactured from durable white wood or light wood with aluminium detailing. In an embodiment, the portable office-in-a-box 100 is manufactured from a thermoplastic, for example, Acrylonitrile Butadiene Styrene (ABS), Nylon, Polycarbonate, Kidex, etc. Kidex is a brand of thermoplastic acrylic-polyvinyl chloride material manufactured by Sekisui SPI of Bloomsburg, Pa., USA, etc.

As illustrated in FIG. 2, the portable office-in-a-box 100 further comprises a workspace 224 that is positioned leftward on the inner surface 202*a* of the base 202. The workspace 224 also functions as a storage area, configured to store, for example, a laptop 104. In an embodiment, the workspace 224 is configured to store a laptop having a length of about 12 to 18 inches, a width of about 8 to 12 inches, and a thickness of about 0.5 inch to 4 inches. In an embodiment, the workspace 224 is configured to store a MacBook Pro 13 inches laptop, manufactured by Apple Inc. of Cupertino, Calif., USA, having a screen size of 13.3 inches with a length of about 12 inches, width of 8.36 inches, and thickness of about 0.6 inch. The enclosures 216 comprise a first recess 226 disposed on the second set 214 of the panels 206, behind the workspace 224. The first recess 226 is configured to store the power adaptors associated with the laptop 104 and the mobile phone 108. In an embodiment, the first recess 226 is configured to be covered with a first lid 227. In an embodiment, the first recess 226 comprises a slot 226*a* configured to allow a charging cable to be drawn out of the first recess 226 and connected to the office items 102, for example, a laptop 104, mobile phone 108, etc. The enclosures 216 further comprises a second recess 228 disposed on the second set 214 of the panels 206 at a frontal right portion 202*b* of the base 202. The second recess 228 is configured to store writing instruments 110. In an embodiment, the second recess 228 is covered using the second lid 229. In an embodiment, the first lid 227 comprises a cut-out (not shown), similar to a cut-out 229*a* on the lid 229 of the second recess 228 to allow a plug of a power adaptor stored in the first recess 226 to be drawn through the cut-out 229*a*.

Figure 3:
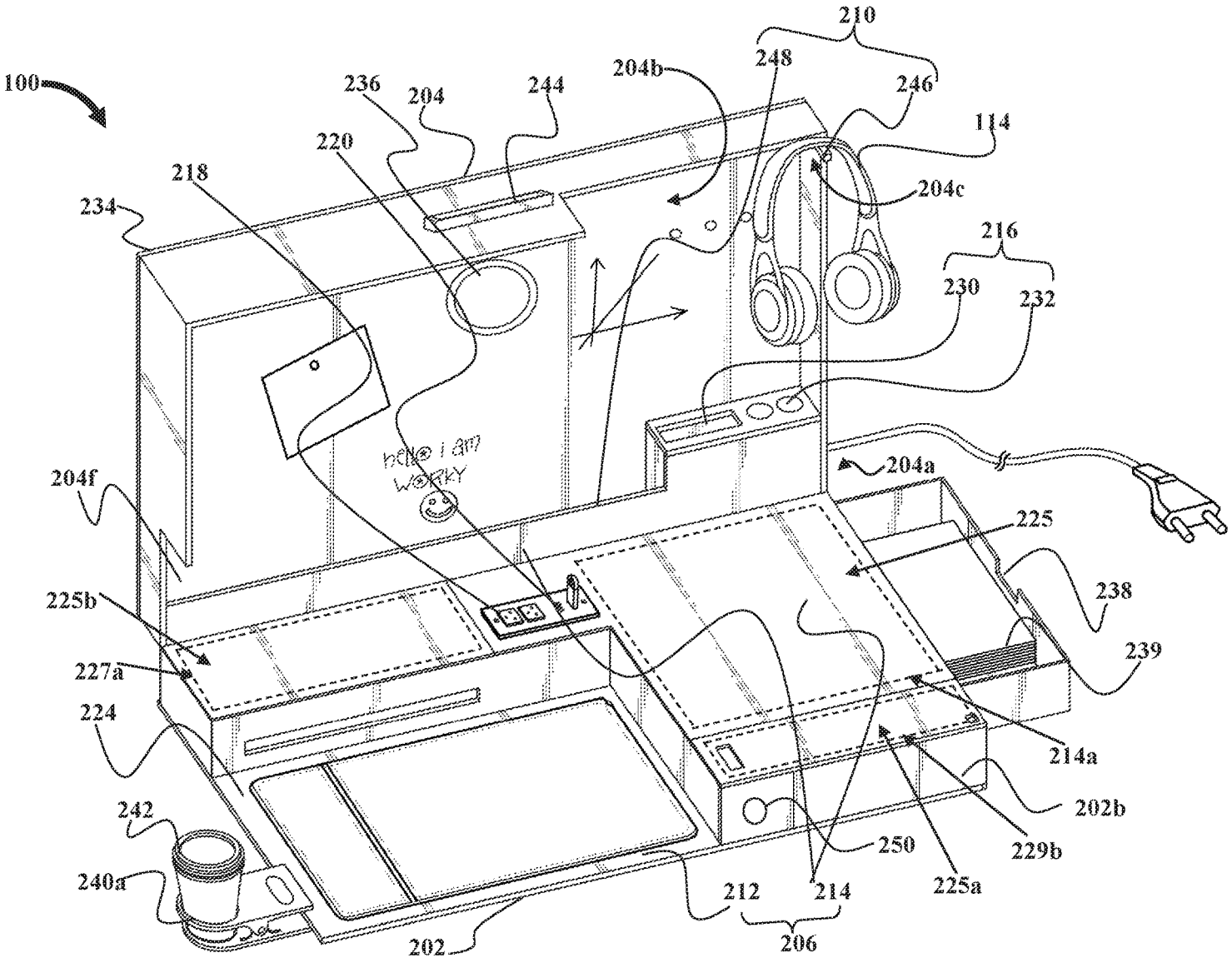
FIG. 3 exemplarily illustrates another front left-side perspective of the portable office-in-a-box in the open configuration.

FIG. 3 exemplarily illustrates another front left-side perspective of the portable office-in-a-box 100 in the open configuration. In an embodiment, the portable office-in-a-box 100 comprises a set of power ports 218 and USB ports 220 disposed on the first set 212 of the panels 206 at about a mid-section of the base 202 and proximal to a hinge 600 between the base 202 and the lid 204, shown in FIGS. 6A-6C, to provide electrical power and media connectivity to electronic devices.

As shown in FIG. 3, in an embodiment, the enclosures 216 comprise a third recess 230 disposed at a bottom right section 204*a* of the lid 204, which is configured to store a 3 inches×3 inches standard post 106. The 3 inches×3 inches standard post 106 comprises a stack of adhesive papers with a re-adherable strip of glue on the back of each paper, where the paper is made to temporarily attach notes on surfaces. The third recess 230 is also configured to store a glue or other adhesive to secure the erasable panel 234 on an upper surface of the lid 204. The enclosures 216 further comprises one or more fourth recesses 232 disposed adjacent to the third recess 230 at the bottom right section 204*a* of the lid 204 to store markers 112 for the erasable panel 234. In an embodiment, the portable office-in-a-box 100 further comprises a magnetic erasable panel 234 disposed on an upper surface 204*d* of the lid 204. In another embodiment, the upper surface 204*d* of the lid 204 is used as an erasable panel. In an embodiment, the erasable panel is a magnetic panel configured to magnetically engage with a magnetic upper surface 204*d* of the lid 204. In an embodiment, the inner surface 204*c* of the lid 204 is used as an erasable panel. The portable office-in-a-box 100 further comprises a light source 236 disposed on the inner surface 204*b* of the lid 204 to provide illumination. In an embodiment, the light source 236 is position on an upper mid-section 204*e* of the inner surface 204*b* of the lid 204, as shown in FIG. 2. The light source 236 is, for example, a USB rechargeable ring light.

In an embodiment, the first set 212 of the panels 206 are configured to support placement or mounting of one or more office items 102 on their surfaces. In an embodiment, a top surface 214*a* of the second set 214 of the panels 206, shown in dotted lines in FIG. 3, that defines a top section of the storage compartment 208 is configured for use as a secondary workspace 225. In an embodiment, a top surface 227*a* of the first lid 227 of the first recess 226 and a top surface 229*b* of the second lid 229 of the second recess 228 are configured to be used as first and second extensions 225*a* and 225*b* of the secondary workspace 225.

As shown in FIGS. 2 and 3, the storage compartments 208 comprise one or more drawers. In another embodiment, the storage compartments 208 comprise a filing cabinet storage compartment 238 recessed within the base 202. In an embodiment, the filing cabinet storage compartment 238 is a drawer configured to store papers 239. As an example, the filing cabinet storage compartment 238 is a foldable storage tray for storage of A4 size paper. In an embodiment, the portable office-in-a-box 100 further comprises one or more cup holders 240*a* and 240*b*. In an embodiment, as shown in FIGS. 1-3, the cup holder 240*a* is a clip-on cup holder 240*a* configured to be attached to the base 202, as shown in FIG.

Figure 4A:
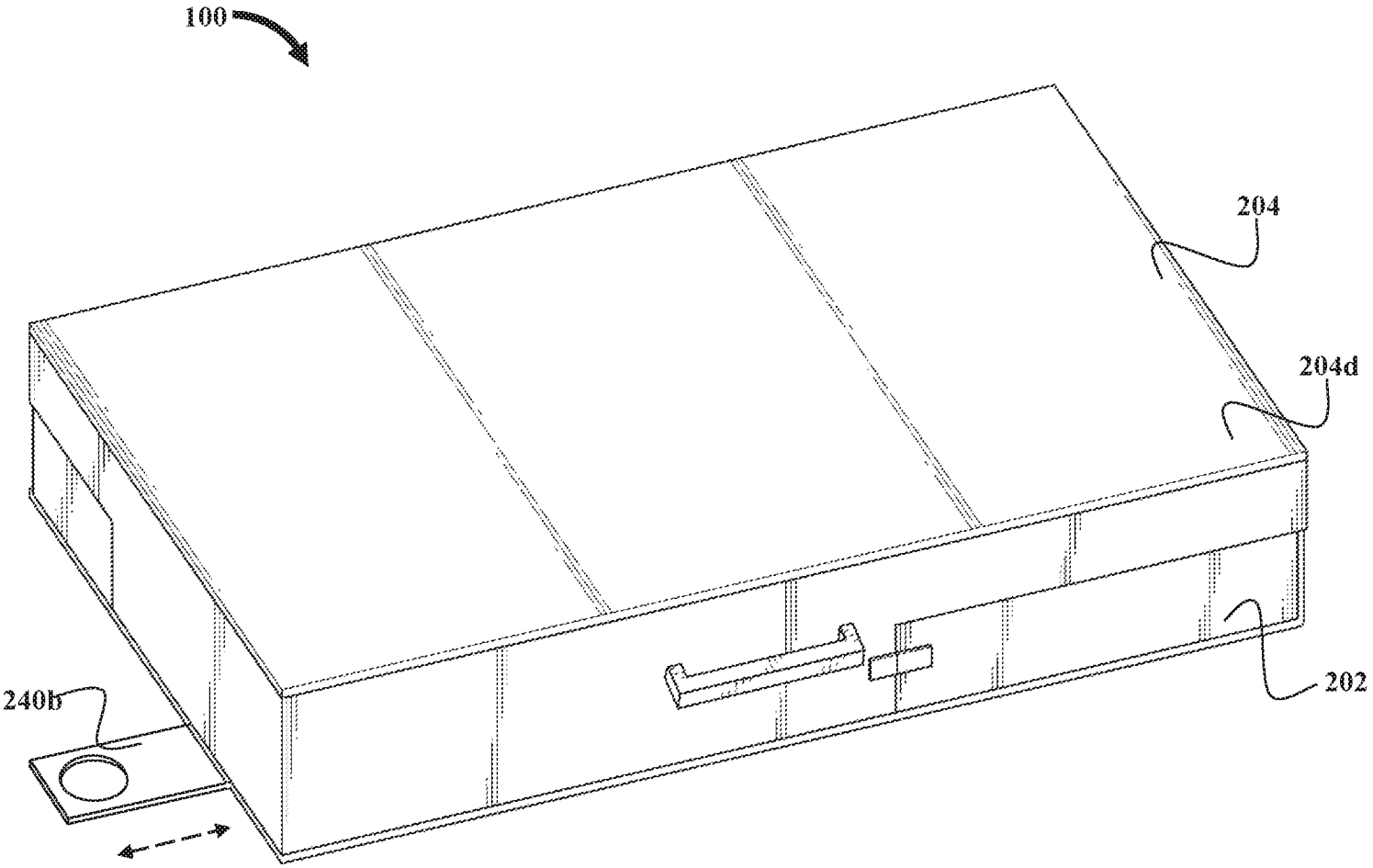
FIG. 4A exemplarily illustrates a front left-side top perspective view of the portable office-in-a-box in a closed configuration.

3. As shown in FIG. 3, the cup holder 240*a* is attached to the base 202 to accommodate a mug or a disposable cup 242. In another embodiment, the cup holder 240*b* is a slide out cup holder, as shown in FIG. 4A. As shown in FIG. 4C, the slide out cup holder 240*b* is integrated and recessed within the base 202 when the portable office-in-a-box 100 is closed. The slide out cup holder 240*b* is extendable from the base 202, as shown by dotted arrow in FIG. 4A, and retracted into the base 202, as shown in FIG. 4C. The portable office-in-a-box 100 comprises a handle 244 to allow the portable office-in-a-box 100 when closed to be carried by a user like a briefcase.

In an embodiment, the mounting fixtures 210 comprises a spring loaded retractable pin 246 disposed at an inner edge 204*c* of the lid 204 for mounting one or more headphones 114, as shown in FIGS. 2 and 3. As illustrated in FIG. 2, when the lid 204 is closed over the base 202, the tip 246*a* of the spring loaded retractable pin 246, as shown in FIG. 1, is pressed against the lid 229 of the second recess 228 to allow the pin 246 to retract in to the lid 204. The spring-loaded retractable pin 246 is configured to be used as a hold-down for the lid 204. The spring-loaded retractable pin 246 further provides an interlock for the lid 204 when the lid 204 is closed over the base 202.

As shown in FIG. 3, the office-in-a box 100 comprises a phone holder channel 248 disposed adjacent to the third recess 230 and at a bottom section of the inner surface 204*b* of the lid 204. The phone holder channel 248 extends from the third recess 230 to a bottom left section 204*f* of said lid 204. The phone holder channel 248 is configured to mount and secure one or more mobile phones 108.

Figure 4B:
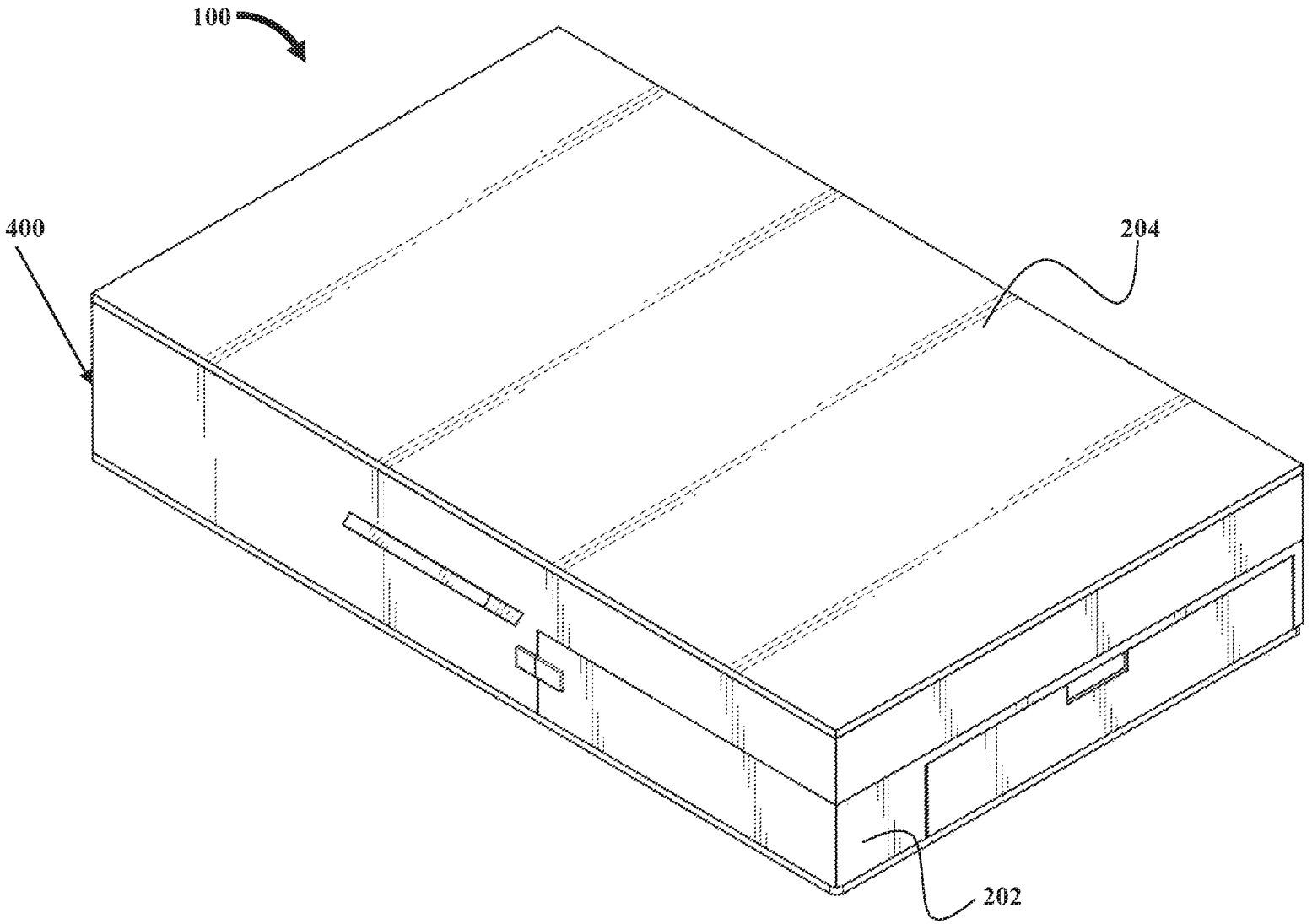
FIG. 4B exemplarily illustrates a front right-side top perspective view of the portable office-in-a-box in the closed configuration.
Figure 4C:
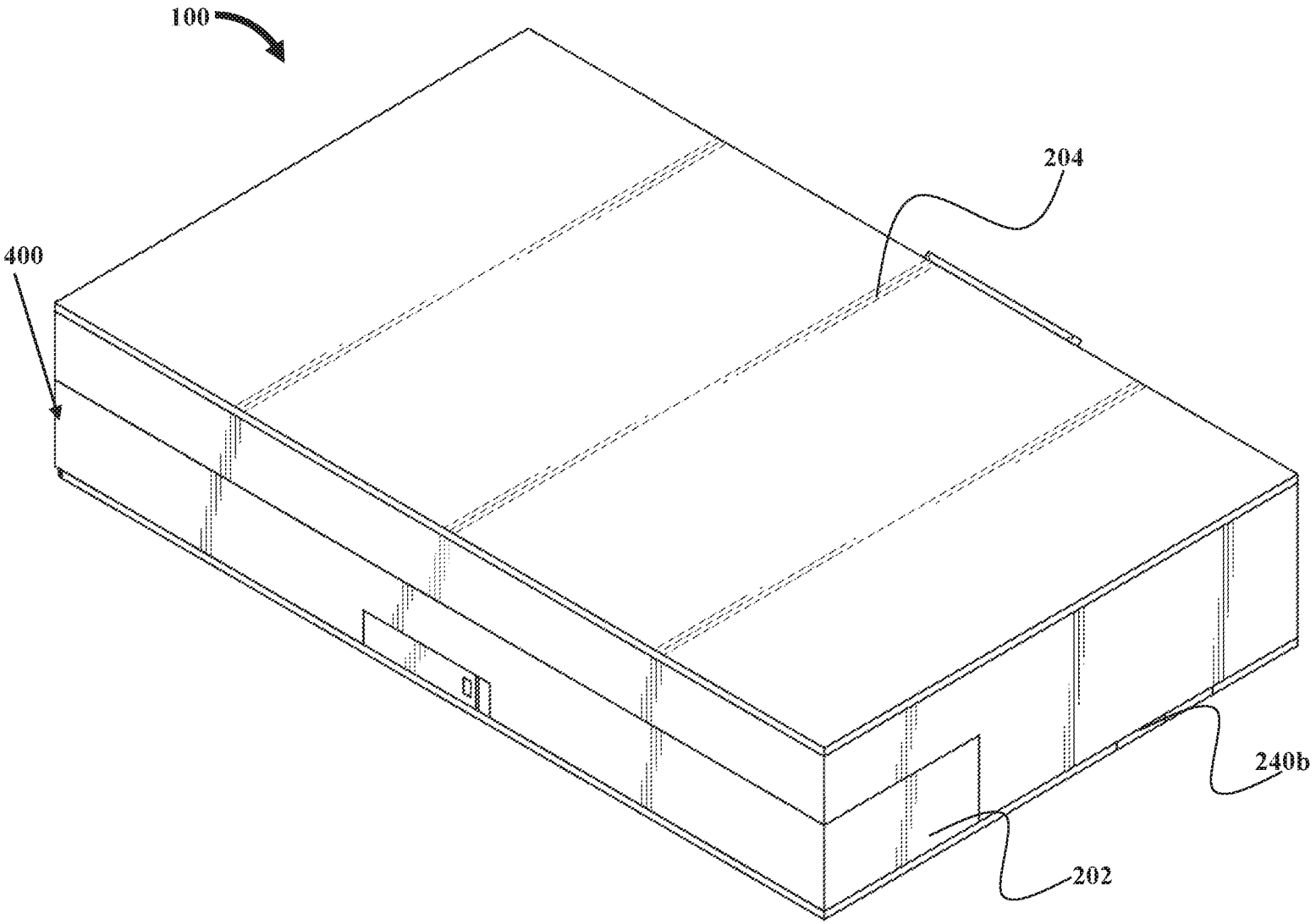
FIG. 4C exemplarily illustrates a rear perspective view of the portable office-in-a-box in a closed configuration.
Figure 4D:
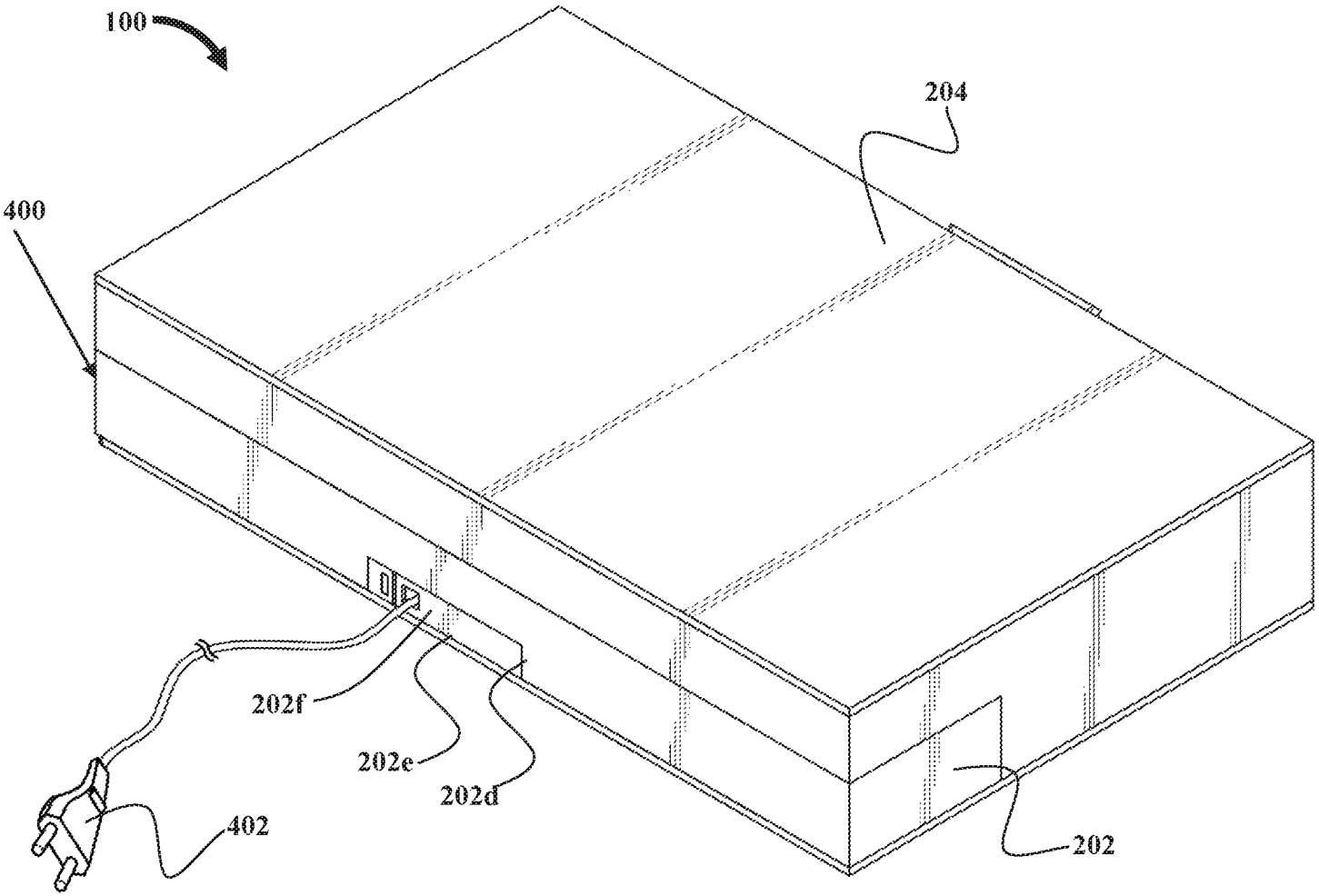
FIG. 4D exemplarily illustrates a plug-in adapter of the portable office-in-a-box in a pulled-out configuration from a rear portion of the portable office-in-a-box.
Figure 5A:
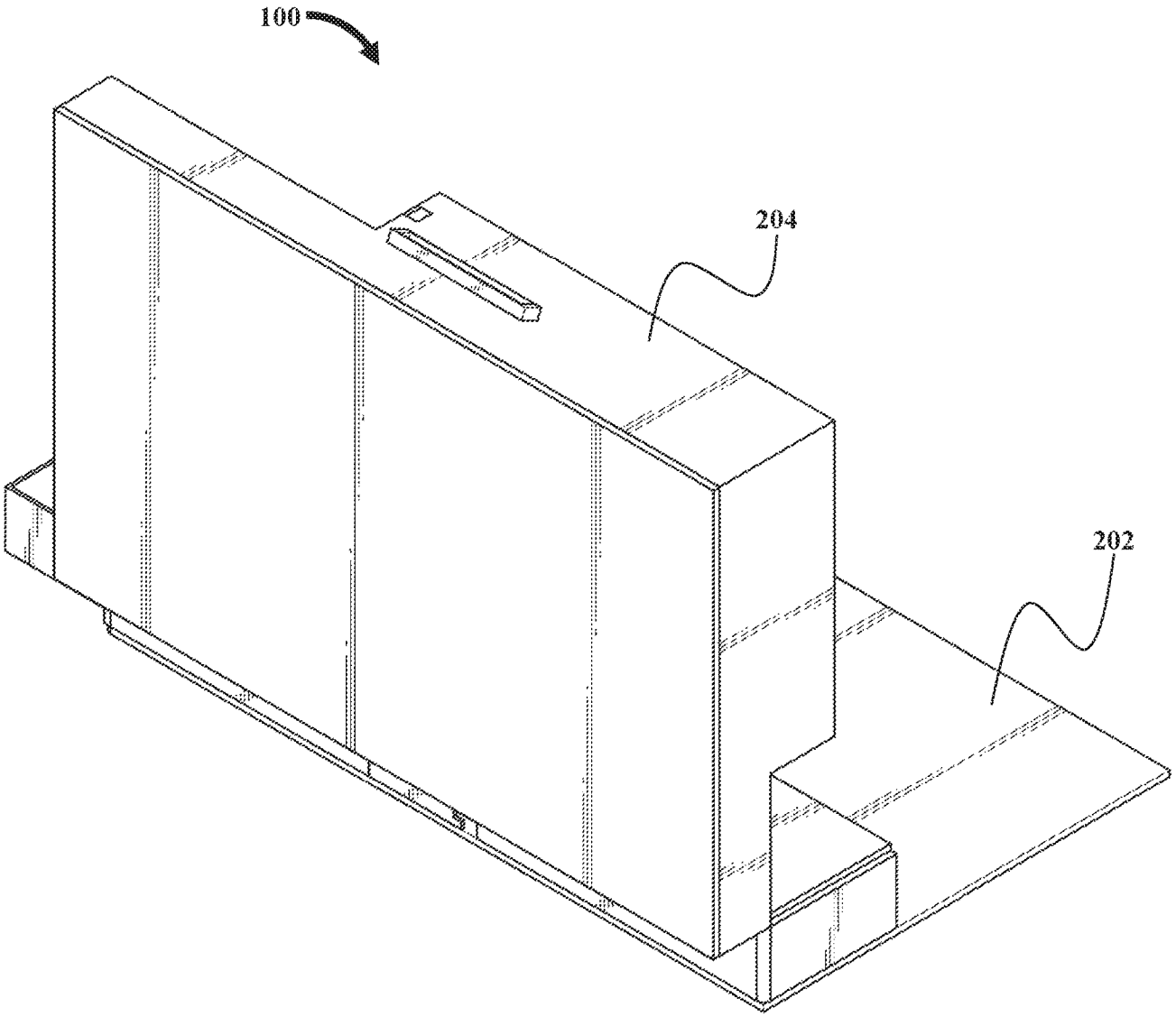
FIG. 5A exemplarily illustrates a rear perspective view of the portable office-in-a-box in the open configuration.
Figure 5B:
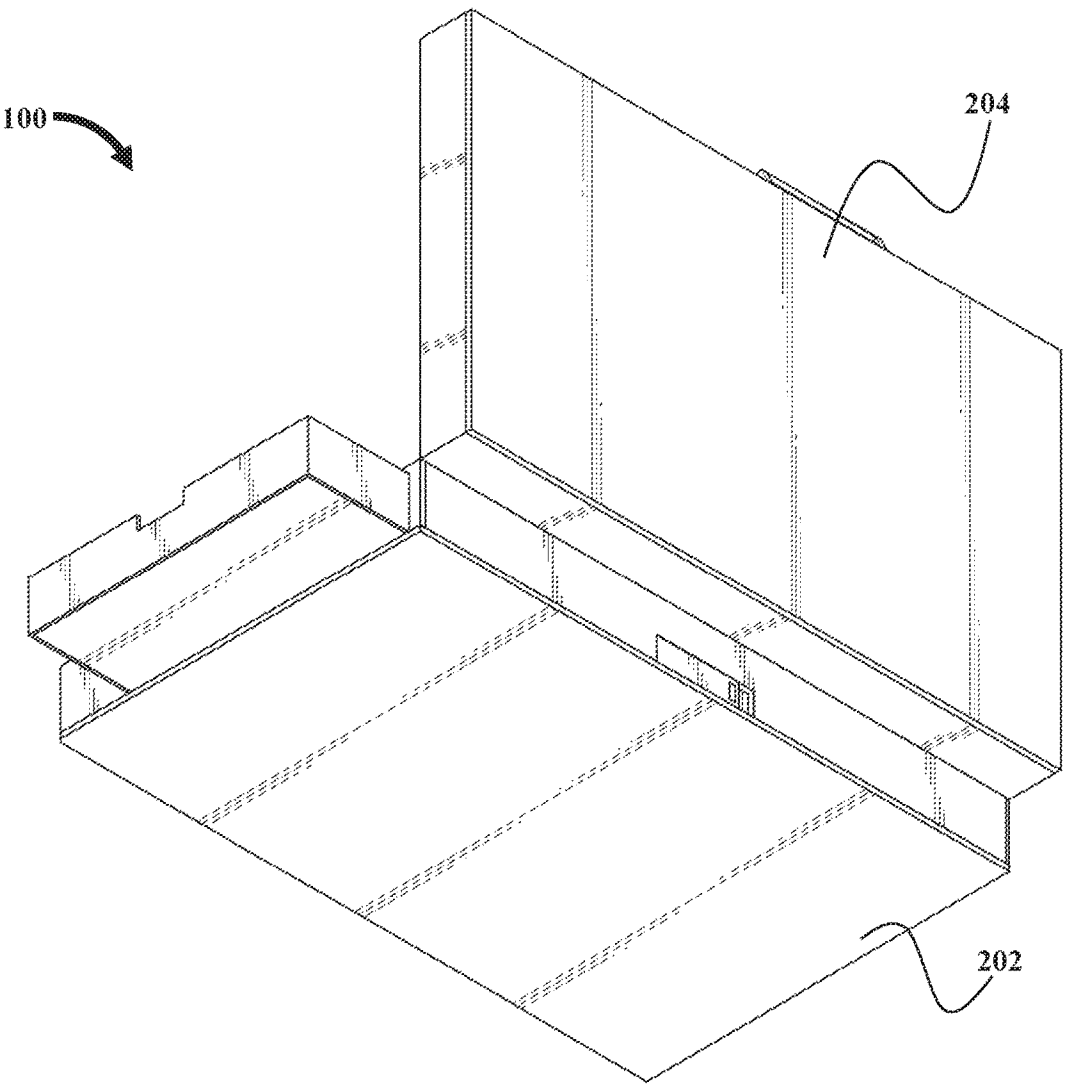
FIG. 5B exemplarily illustrates a bottom perspective view of the portable office-in-a-box in an open configuration.
Figure 5C:
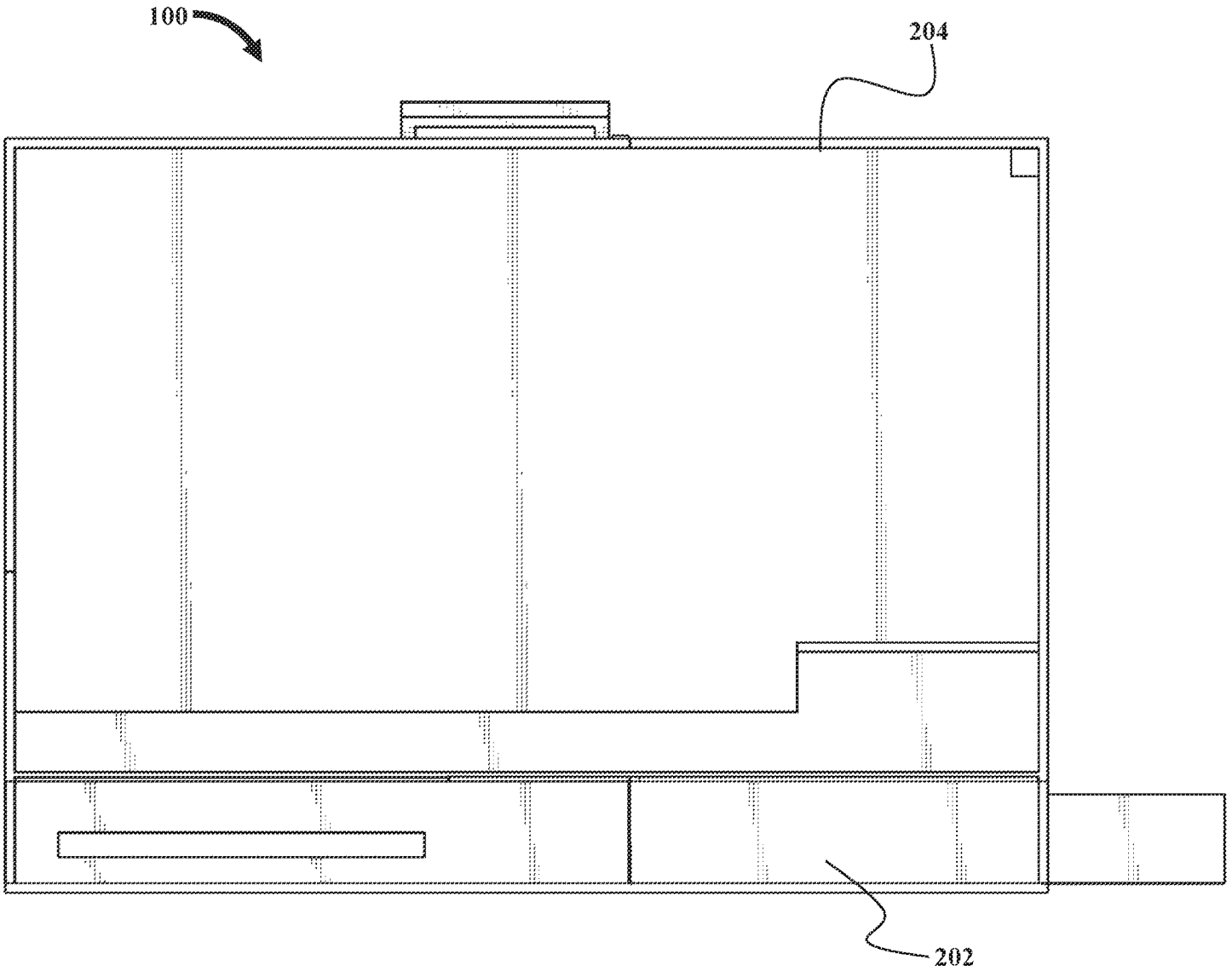
FIG. 5C exemplarily illustrates a front orthogonal view of the portable office-in-a-box in the open configuration.
Figure 5D:
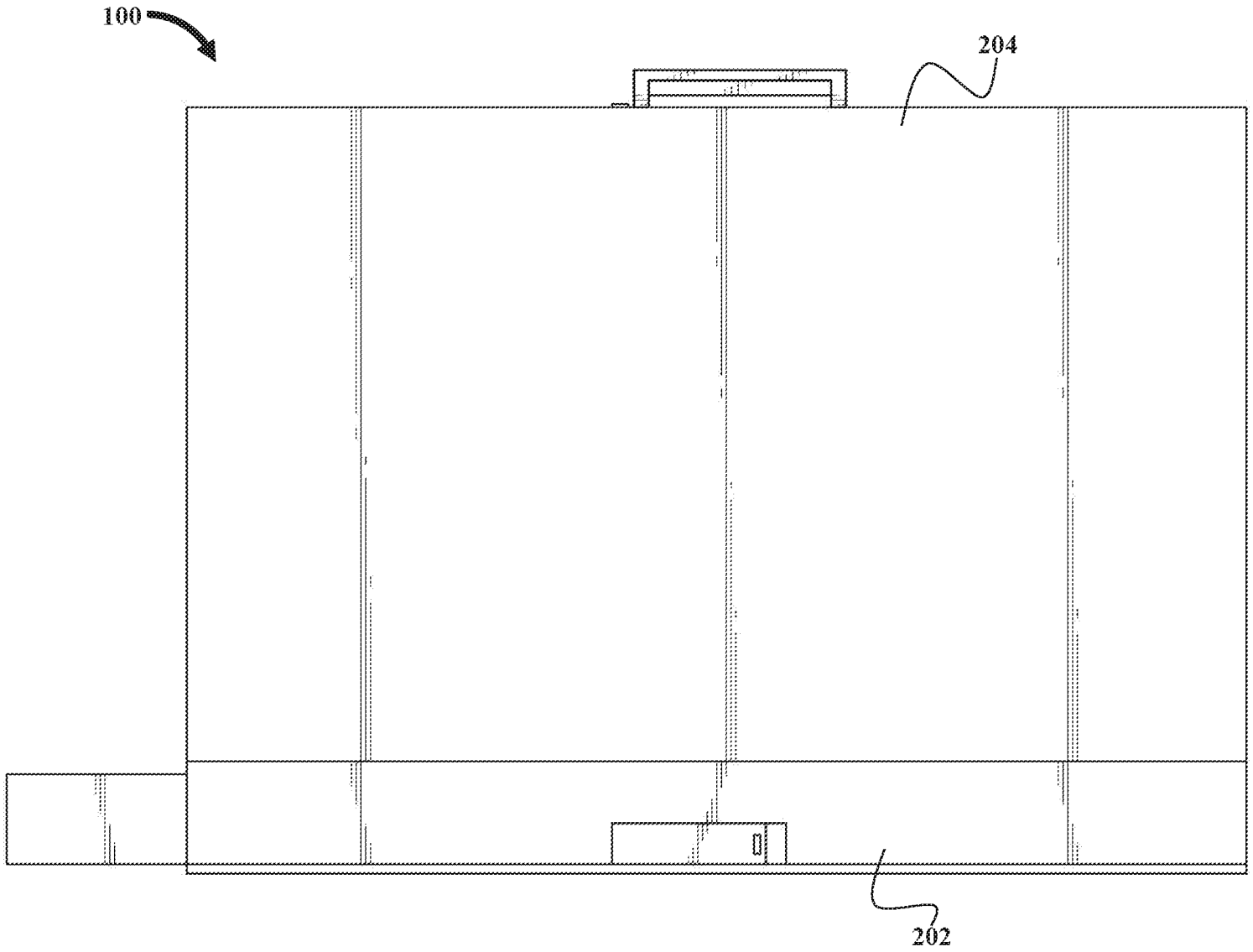
FIG. 5D exemplarily illustrates a rear orthogonal view of the portable office-in-a-box in the open configuration.
Figure 5E:
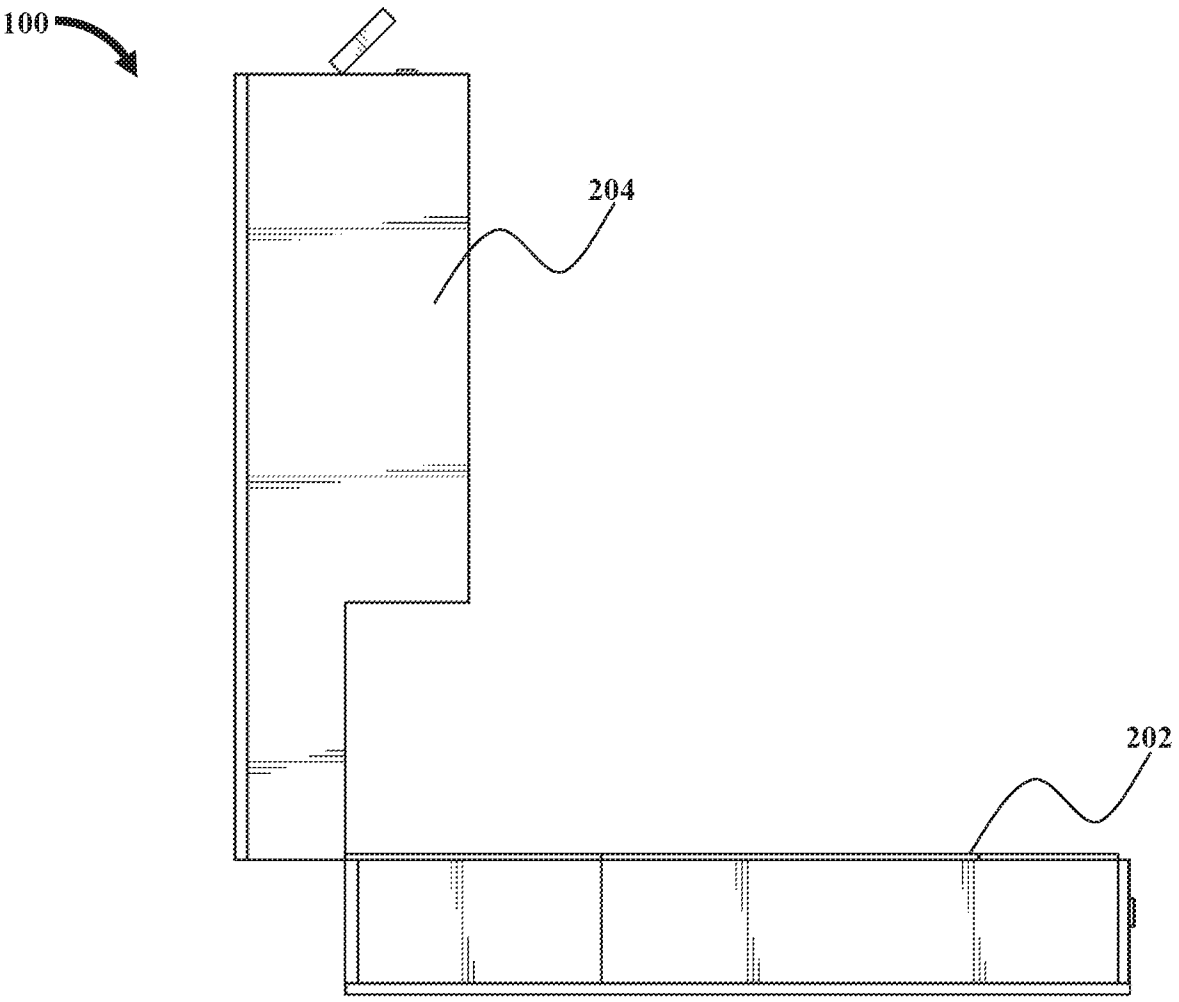
FIG. 5E exemplarily illustrates a left side orthogonal view of the portable office-in-a-box in the open configuration.
Figure 5F:
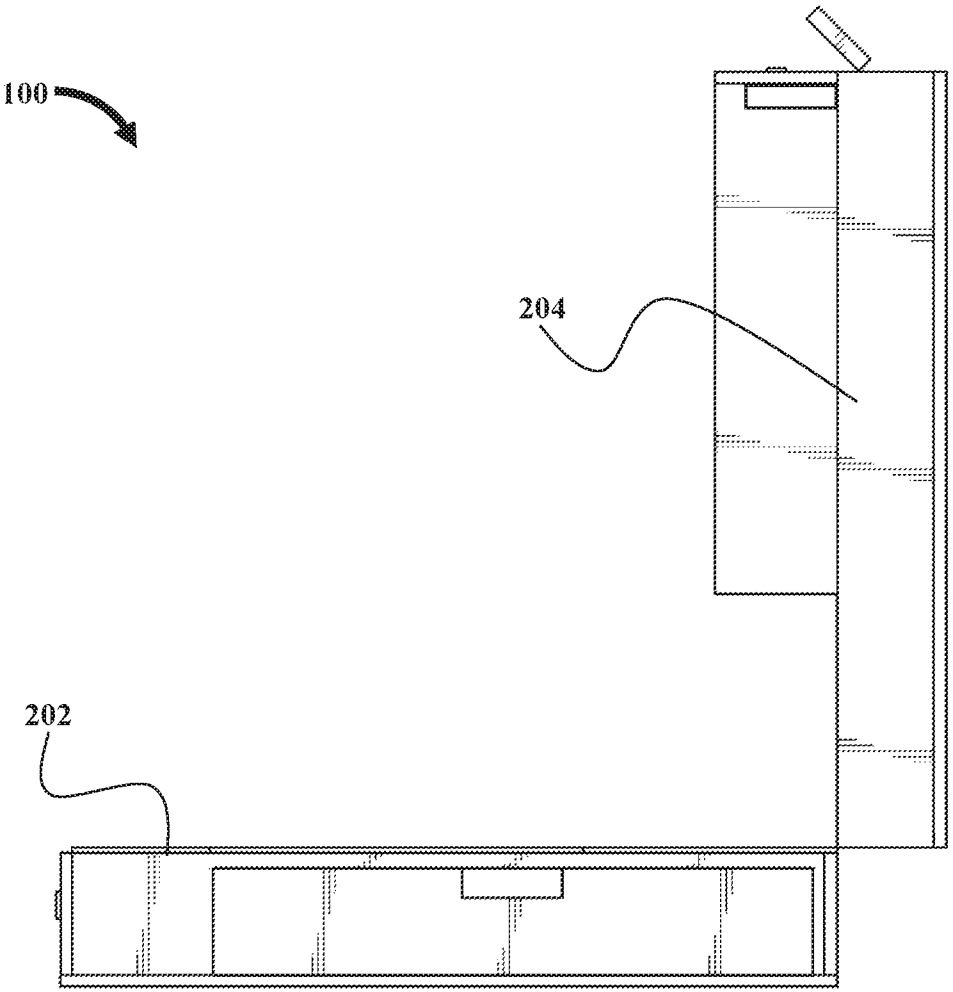
FIG. 5F exemplarily illustrates a right-side orthogonal view of the portable office-in-a-box in the open configuration.
Figure 5G:
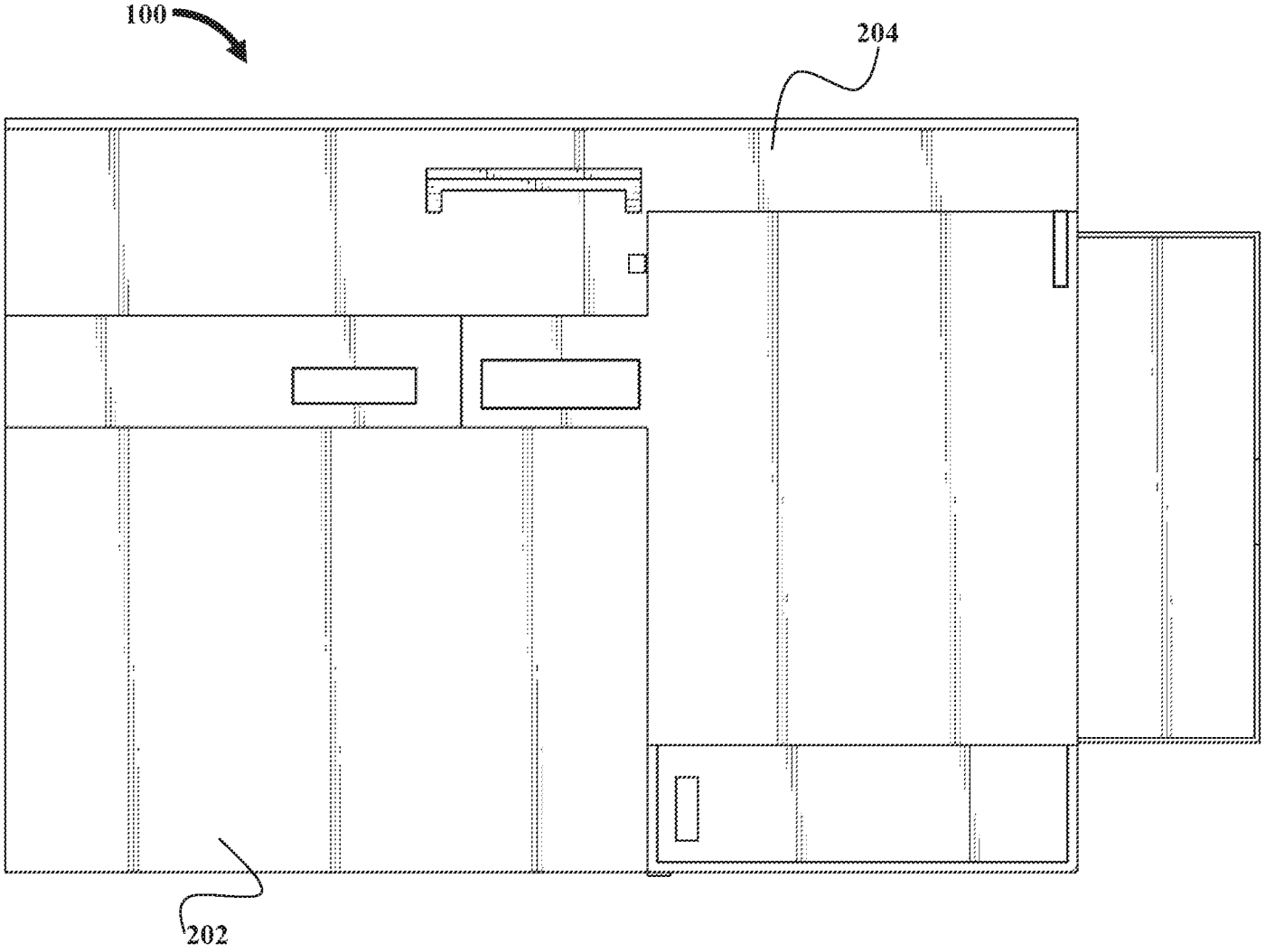
FIG. 5G exemplarily illustrates a top plan view of the portable office-in-a-box in the open configuration.

FIGS. 4A-4C exemplarily illustrates a front left-side top perspective view, another top perspective view, and a rear perspective view respectively of the portable office-in-a-box 100 in the closed configuration. FIG. 4D exemplarily illustrates a plug-in adapter 402 of the portable office-in-a-box 100 that extends from a rear portion 202*d* of the portable office-in-a-box 100. The plug-in adapter 402 is stored within a recess 202*e* at the rear portion 202*d* of the portable office-in-a-box 100. The recess 202*e* comprises a door 202*f* that slidably engages with the rear portion 202*d* to close the recess 202*e* when the plug-in adapter 402 is retracted into the recess 202*e* and to open the recess 202*e* when the plug-in adapter 402 is extended from the recess 202*e*.

FIGS. 5A-5G exemplarily illustrates a rear perspective view, a bottom perspective view, a front orthogonal view, a rear orthogonal view, a left side orthogonal view, a right-side orthogonal view and a top plan view respectively, of the portable office-in-a-box 100 in an open configuration.

Figure 6A:
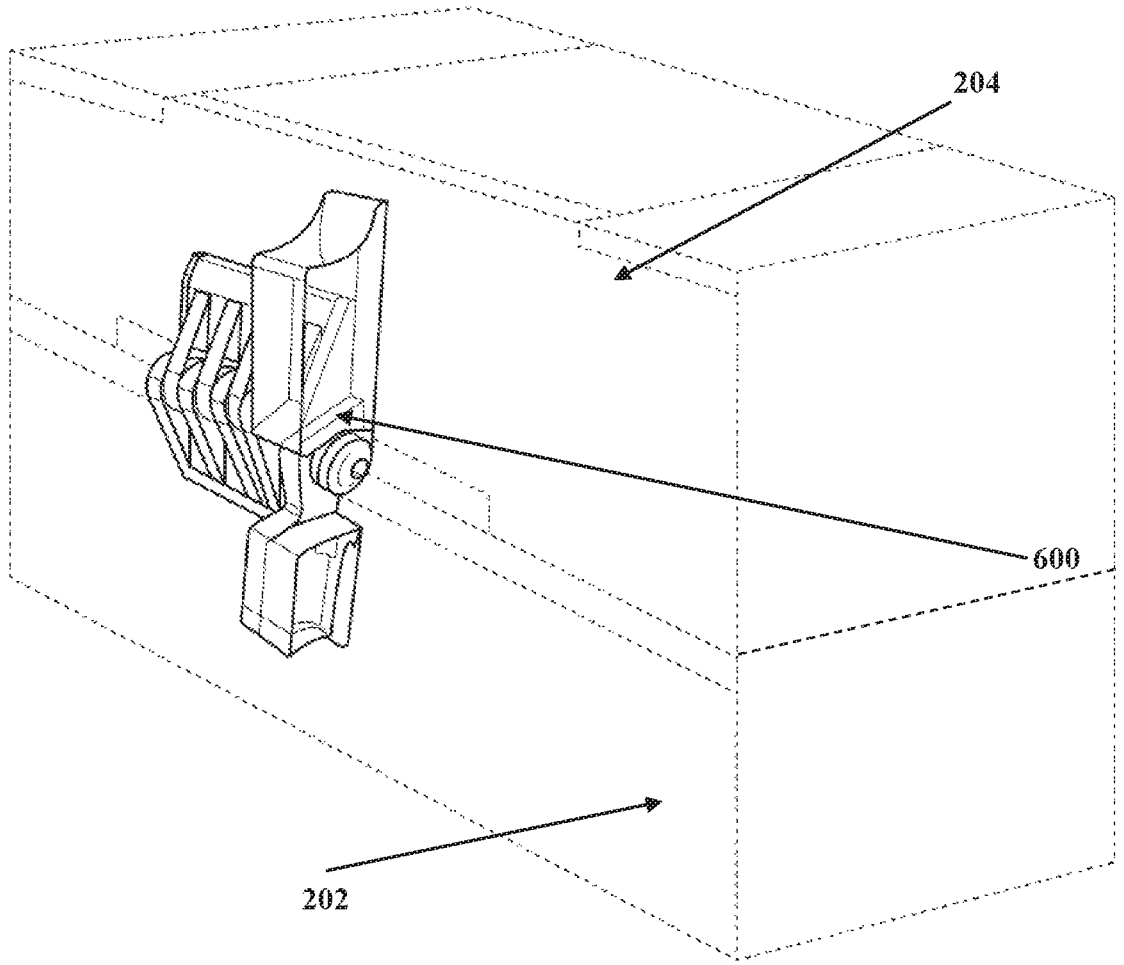
FIGS. 6A-6C exemplarily illustrate a hinge disposed between the lid and the base for hingedly connecting the lid and the base.
Figure 6B:
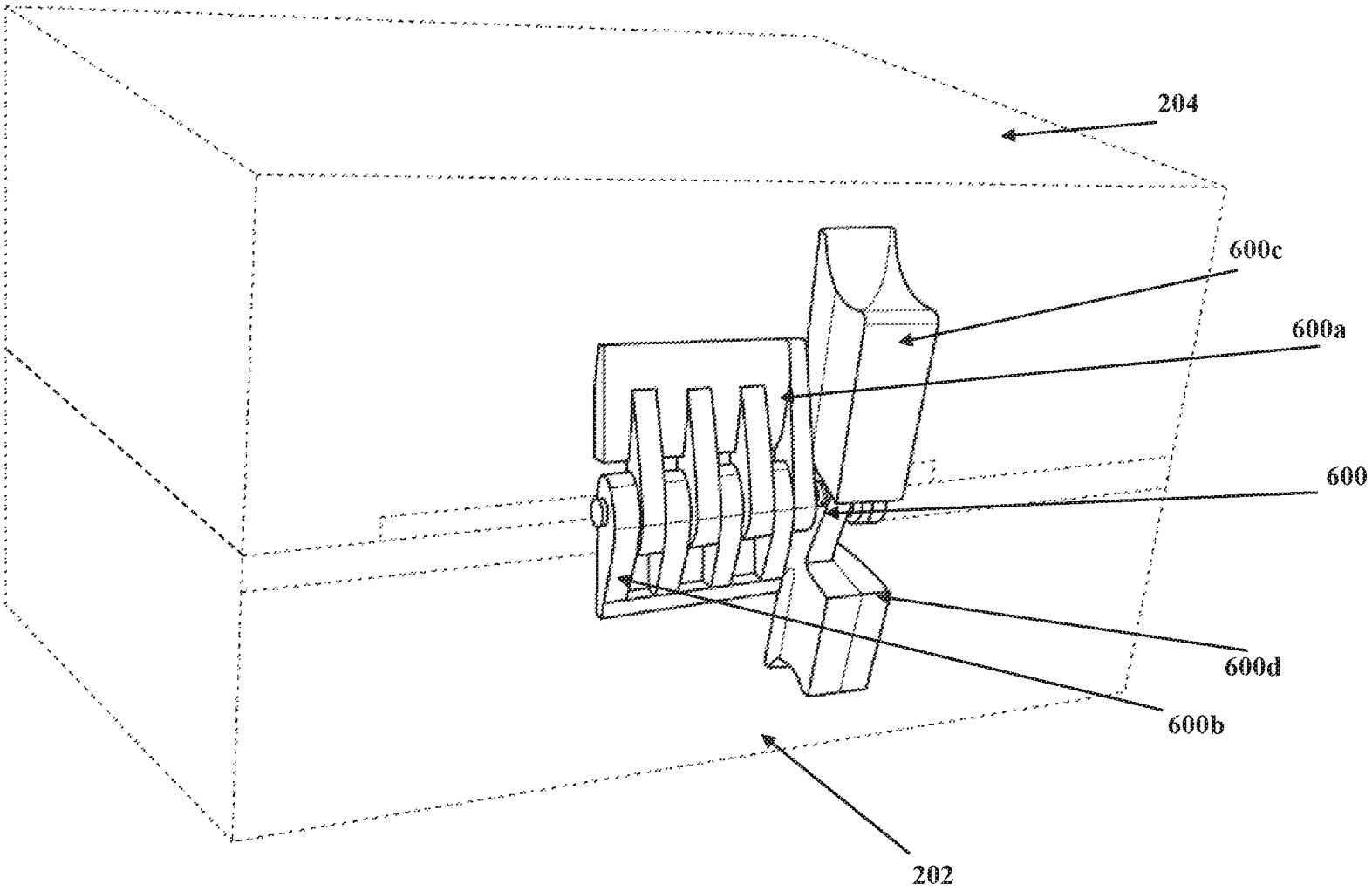
Figure 6C:
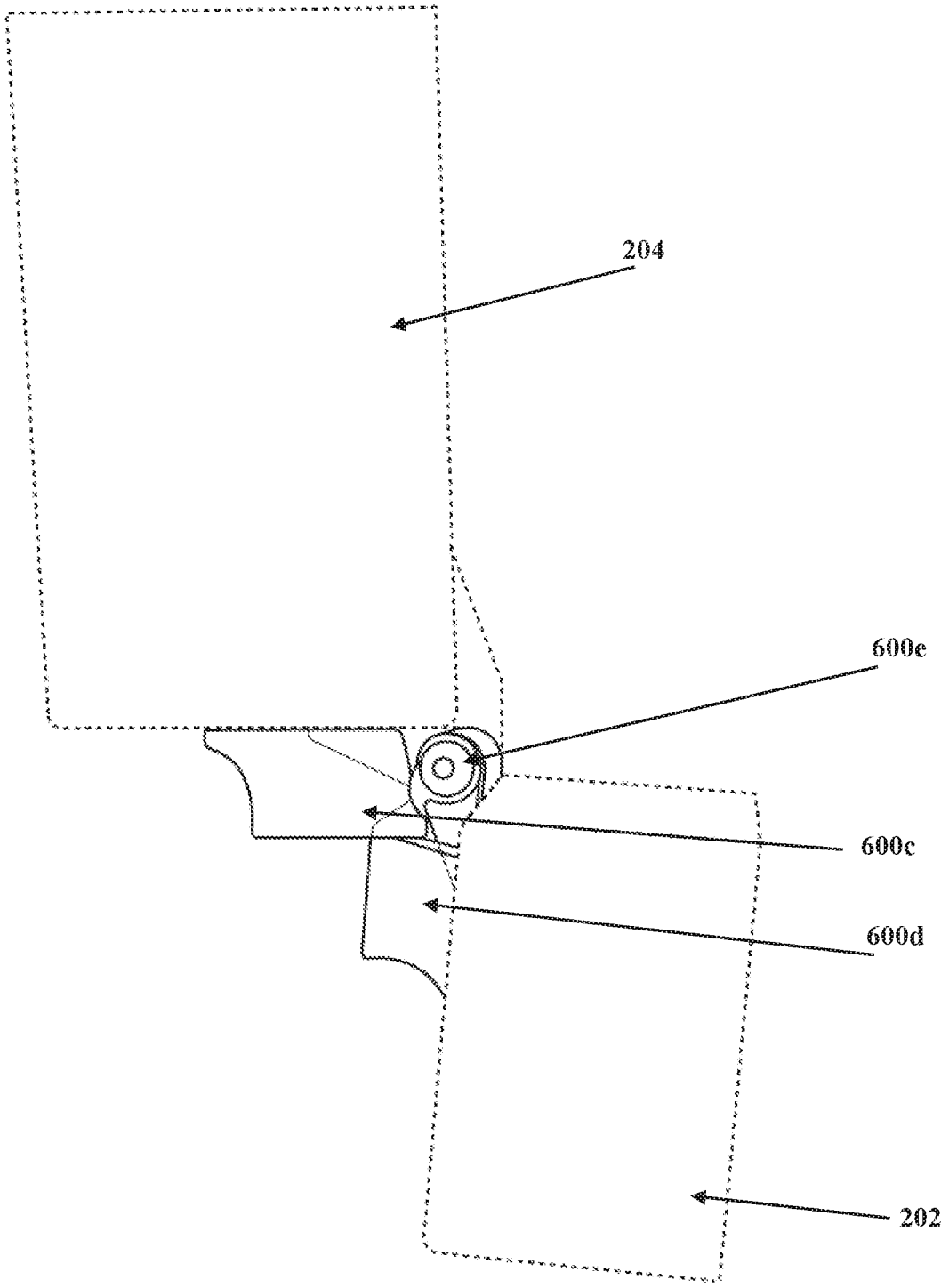

In an embodiment, FIG. 6A-6C illustrates the portable office-in-a-box 100 with a hinge 600 disposed between the lid 204 and the base 202, for hingedly connecting the lid 204 to the base 204. In an embodiment, the hinge 600 is a piano type hinge comprising a first wing 600*a* attached to the lid 204 and a second wing 600*b* attached to the base 202, as shown in FIG. 6B. The first and second wings 600*a* and 600*b* rotatably engage with a pin 600*e*, disposed on either sides of the pin 600*e*, as shown in FIG. 6C. The hinge 600 is made of flexible nylon or a synthetic plastic. In an embodiment, the hinge 600 comprises a first stopper 600*c* attached to the first wing 600*a*, and a second stopper 600*d* attached to the second wing 600*d*, as shown in FIG. 6B. As shown in FIG. 6C, the first stopper 600*c* is configured to engage with the second stopper 600*d* when the lid is opened to prevent the lid 204 from tilting beyond a certain angle with respect to the base 202. In an embodiment, the hinge 600 is configured to position the lid 204 substantially perpendicular to the base 202 when the lid 204 is completely opened. In an embodiment, the hinge 600 is configured to position the lid 204 at any angle between 90 degrees to 120 degrees. In an embodiment, the hinge 600 comprises a lockable pin 600*e* configured to lock the lid 204 with the base 202, at any angle between 60 degrees to 120 degrees. In an embodiment, the portable office-in-a-box 100 further comprises a security latch 250 disposed at a frontal right portion 202*b* of the base 202. The security latch 250 is configured to provide a user secure access to the portable office-in-a-box 100.

The portable office-in-a-box 100 is compact and is shipped to customers in a lid-type cardboard box (not shown) that opens on the side where the handle 244 of the portable office-in-a-box 100 is present. Once the cardboard box is opened, a customer can easily remove the portable office-in-a-box 100 out of the cardboard box. In an embodiment, the cardboard box conforms to drop requirement ASTM D5276-19.

The foregoing examples have been provided merely for illustration and are in no way to be construed as limiting of the portable office-in-a-box 100 disclosed herein. While the portable office-in-a-box 100 has been described with reference to various embodiments, it is understood that the words, which have been used herein, are words of description and illustration, rather than words of limitation. Further, although the portable office-in-a-box 100 has been described herein with reference to particular means, materials, and embodiments, the portable office-in-a-box 100 is not intended to be limited to the particulars disclosed herein; rather, the functionality extends to all functionally equivalent structures and uses, such as are within the scope of the appended claims. Those skilled in the art, having the benefit of the teachings of this specification, may effect numerous modifications thereto and changes may be made without departing from the scope and spirit of the portable office-in-a-box 100 disclosed herein in their aspects.

We claim:

1. A portable office-in-a-box, comprising:

a rectangular shaped box comprising a base and a lid, said lid configured to engage with the base to define the rectangular shape box;

said rectangular shaped box configured to accommodate one or more office items and accessories, wherein said office items and accessories are either stored or mounted within said rectangular shaped box, and wherein said office items and accessories accommodated within said rectangular shaped box comprise:

a laptop, wherein a workspace within said rectangular shaped box is configured as a laptop holder for placing said laptop when said laptop is in use, and wherein the workspace is further configured to store said laptop when said laptop is not in use;

built-in power ports;

built-in Universal Serial Bus (USB) ports;

a built-in light source, wherein the light source is a Universal Serial Bus (USB) rechargeable ring light;

a built-in erasable magnetic board, wherein said built-in erasable magnetic board is configured to perform as a writing surface and a dry erase board;

a headphone, wherein a built-in headphone hook is configured to mount said headphone;

markers, wherein a built-in markers holder is configured to store said markers;

a 3 inches×3 inches standard post, wherein a built-in post holder is configured to store said 3 inches×3 inches standard post;

a set of cables, wherein a built-in cable compartment is configured to store said cables when said rectangular shaped box is closed, and wherein said built-in cable compartment is further configured for the cables to be pulled out when said rectangular shaped box is opened;

papers, wherein a built-in filing cabinet is configured to store said papers;

writing instruments, wherein a built-in compartment is configured to store said writing instruments;

mobile phones, wherein a mobile phone holder is configured for mounting said one or more mobile phones;

a mouse;

a charger;

a portable printer;

a portable scanner; and a webcam;

one or more storage compartments disposed in said base of said rectangular shaped box for said storage of said office items and accessories, wherein said one or more storage compartments are configured as one of pull-out compartments and panel enclosed compartments; and a plurality of mounting fixtures disposed on the inner surface of said lid for said mounting of said office items and accessories.

2. The portable office-in-a-box of claim 1, wherein said built-in power ports and said built-in USB ports are positioned in a mid-section of said base and proximal to a hinge between said base and said lid, to provide electrical power and media connectivity to electronic devices accommodated within said rectangular shaped box, when said electronic devices are in use.

3. The portable office-in-a-box of claim 2, further comprising one or more panels configured for one or more of creating said storage compartments and acting as workspaces for placement of said electronic devices.

4. The portable office-in-a-box of claim 1, wherein said magnetic erasable panel is disposed on an upper surface of said lid.

5. The portable office-in-a-box of claim 1, wherein said light source is disposed on said inner surface of said lid to provide illumination.

6. The portable office-in-a-box of claim 1, further comprising a cup holder configured to extend out of or retract into said rectangular shaped box.

7. The portable office-in-a-box of claim 1, wherein one of said mounting fixtures comprises a phone holder channel configured to mount said one or more of said mobile phones.

8. The portable office-in-a-box of claim 1, further comprises a hinge disposed between said lid and said base, wherein said hinge is a piano type hinge.

* * * * *